United States Patent [19]

Gold

[11] Patent Number: 4,627,323

[45] Date of Patent: Dec. 9, 1986

[54] PITCH EXTRACTOR APPARATUS AND THE LIKE

[75] Inventor: Calman Gold, Post Mills, Vt.

[73] Assignee: New England Digital Corporation, White River Junction, Vt.

[21] Appl. No.: 639,737

[22] Filed: Aug. 13, 1984

[51] Int. Cl.[4] ..... G10H 1/00; G10H 3/18

[52] U.S. Cl. ..... 84/1.01; 84/1.16

[58] Field of Search ..... 84/1.01, 1.11–1.16, 84/1.19–1.23, 1.28, 462

[56] References Cited

U.S. PATENT DOCUMENTS

| | | | |
|---|---|---|---|
| 3,539,701 | 11/1970 | Milde | 84/1.28 |
| 3,591,699 | 7/1971 | Cutler | 84/1.22 X |
| 3,647,929 | 3/1972 | Milde, Jr. | 84/1.01 |
| 3,812,432 | 5/1974 | Hanson | 84/1.12 X |
| 4,014,237 | 3/1977 | Milde, Jr. | 84/1.12 |
| 4,133,241 | 1/1979 | Niimi et al. | 84/1.01 |
| 4,151,775 | 5/1979 | Merriman | 84/1.01 |
| 4,246,823 | 1/1981 | Wachi et al. | 84/1.22 |
| 4,377,961 | 3/1983 | Bode | 84/1.01 |
| 4,392,409 | 7/1983 | Coad, Jr. et al. | 84/462 |

*Primary Examiner*—S. J. Witkowski

*Attorney, Agent, or Firm*—Robert Shaw

[57] ABSTRACT

A method of (and apparatus for) extracting the fundamental pitch period of a complex electrical signal $V_2(t)$, that includes the serial steps of deriving a time varying reference signal $V_{ref}(t)$ from the complex electrical signal $V_2(t)$, which reference signal $V_{ref}(t)$ adapts continuously (i.e., each cycle of the complex electrical signal) to peak amplitude excursions of the complex electrical signal $V_2(t)$; sensing ascending values of the signal $V_2(t)$ to a first point at which the maximum magnitude of the signal $V_2(t)$ of one polarity is reached and reversal of direction thereof occurs; storing the first substantially instantaneous difference in magnitude between the complex electrical signal $V_2(t)$ and the time varying reference $V_{ref}(t)$ at the point of maximum magnitude of the signal $V_2(t)$; thereafter sensing a point at which the magnitude of the signal $V_2(t)$ minus the first substantially instantaneous difference equals zero; thereafter sensing ascending values of the signal $V_2(t)$ to a further point at which a maximum magnitude of the signal $V_2(t)$ of opposite polarity to the one polarity is reached and reversal of direction thereof occurs; then storing the value of the signal $V_2(t)$ at the further point and sensing ascending value of the signal $V_2(t)$ to a still further point at which the substantially instantaneous value of the signal $V_2(t)$ exceeds the stored value of the reference signal $V_{ref}(t)$, the pitch period being the time span between successive occurrences of the still further point.

23 Claims, 11 Drawing Figures

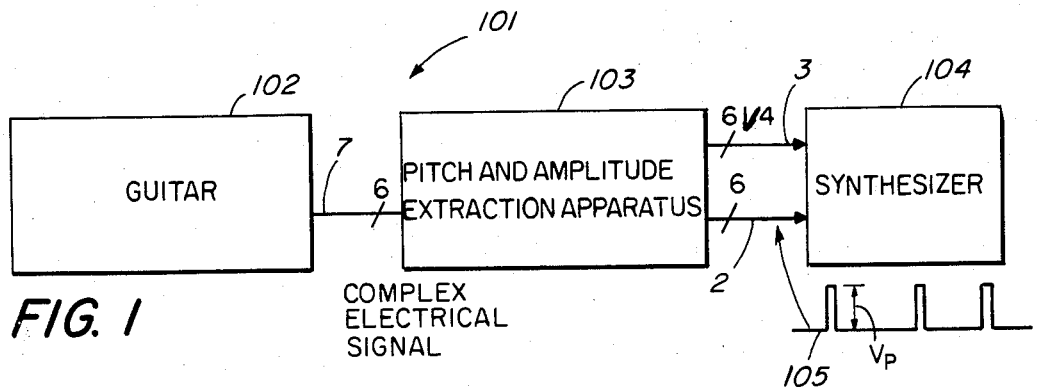
FIG. 1
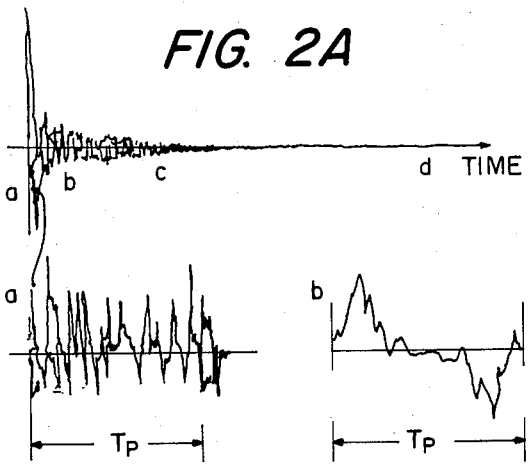
FIG. 2A
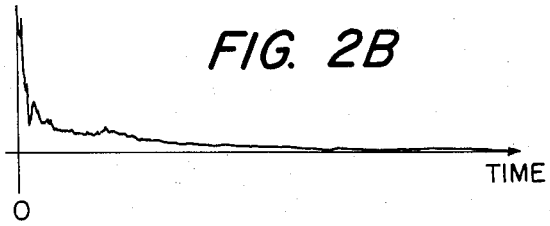
FIG. 2B
FIG. 2C(a)
FIG. 2C(b)
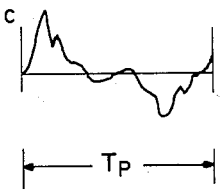
FIG. 2C(c)
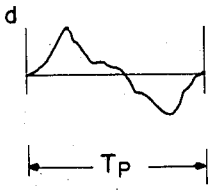
FIG. 2C(d)
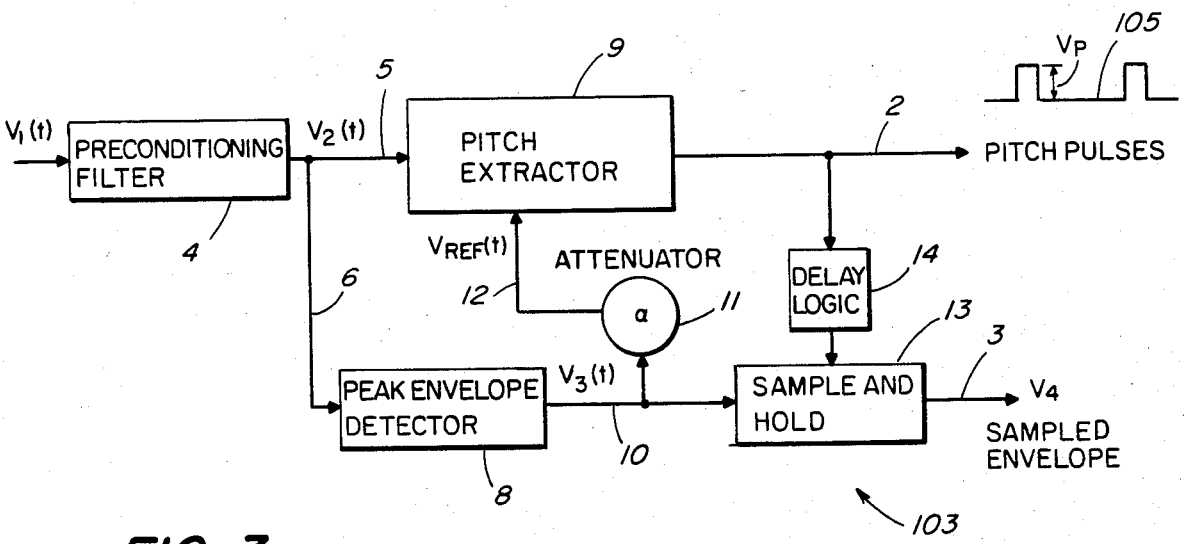
FIG. 3

PITCH EXTRACTOR APPARATUS AND THE LIKE

The present invention relates to apparatus to extract the fundamental pitch period of a complex periodic elctrical signal and, in preferred form, to extract also a mesurement of the peak amplitude of the complex electrical signal during each pitch period.

To place the invention in context, attention is called to U.S. Pat. Nos. 4,108,035 (Alonso), 4,178,822 (Alonso), 4,279,185 (Alonso) and 4,345,500 (Alonso et al), all of which disclose aspects of digital music synthesizers.

Although the invention is broader in scope, it is described in greatest detail in the context of an electronic guitar, but the concepts can be employed using other string or other instruments and those concepts have value in other than acoustic devices. In a typical application pitch and amplitude of musical note from a single string of a guitar is analyzed and from these are extracted pitch of the fundamental of the note and amplitude (i.e., a signal indicative of the level of energy of the note by virtue of the strength at which the string was plucked and which would be sound level from a conventional acoustic guitar). In this specification the term "note" is used in its usual sense to denote a pure musical tone of definite pitch, i.e., C, D, E, F, G, A and B.

As described in greater detail later, the output of the extractor is fed as input to a digital synthesizer of the type, for example, described in the above-identified patents and more particularly in an application for Letters Patent Ser. No. 572,625, filed Jan. 24, 1984, Alonso et al, (now U.S. Pat. No. 4,554,855) which discloses a multi-channel synthesizer. The synthesizer can use the pitch information as a basis for generating, say, the sound of a pipe organ, the amplitude information being used to control loudness of a particular note. In fact, the typical system uses isolated inputs from each string of a six-string guitar to provide an output.

For the purpose of this discussion, a complex electric signal is one which may contain not only a fundamental periodic component, but also a multitude of harmonic or nonharmonic components, the amplitudes and phases of which need not bear a constant relationship to the amplitude and phase of the fundamental periodic component. The invention provides a way to measure both the fundamental pitch period and the amplitude of each of a plurality of such complex electrical signals transduced individually from the vibrating strings of the electronic guitar. The digitally encoded measurements of pitch and amplitude from these transduced signals can be subsequently conveyed to a computer or otherwise automated electronic complex wave synthesis device in order to produce musical sounds other than the original, yet exhibiting pitch and amplitude variations controlled by the pitch and amplitude characteristics of the guitar strings themselves. However, the concepts disclosed herein are robust enough to be applied to other electrical signals from other musical instruments or devices, not necessarily musical, the utility of which would benefit from application of the methods described herein.

Later there is a brief overview of both the problems inherent in extracting a measure of the fundamental pitch period from a complex electrical signal and the limitations and complexities of traditional approaches to this problem. What is shown is that the present invention is both unique and robust in its method of operation and is an improvement in the state-of-the-art. Furthermore, the direct conversion of pitch measurement to a digital code permits a higher pitch period resolution and stability of measurement than can be achieved by pitch-to-voltage conversion methods which are prone to drift, require an aboslutely calibrated voltage to pitch reference, and would require an additional step of analog-to-digital conversion before use on a computer system.

Accordingly it is an objective of the present invention to provide apparatus to extract the fundamental pitch period of a complex periodic electrical signal.

Another object is to provide apparatus that can also extract peak amplitude of the signal for the particular pitch period.

Still another objective is to provide apparatus which can interface with an acoustic synthesizer and provide input to the synthesizer which generates music on the basis of the pitch and amplitude information.

These and still further objectives are addressed hereinafter.

The foregoing objectives are achieved, generally, in a method (and apparatus) for extracting the fundamental pitch period of a compelx electrical signal $V_2(t)$, that comprises the serial steps of deriving a time varying reference signal $V_{ref}(t)$ from the complex electrical signal $V_2(t)$, which reference signal $V_{ref}(t)$ adapts continuously (i.e., each cycle of the fundamental) to peak amplitude excursions of the complex electrical signal $V_2(t)$; sensing ascending values of the signal $V_2(t)$ to a first point at which the maximum magnitude of the signal $V_2(t)$ of one polarity is reached and reversal of direction thereof occurs; storing the first substantially instantaneous difference in magnitude between the complex electronic signal $V_2(t)$ and the time varying reference $V_{ref}(t)$ at said first point; sensing a point at which the magnitude of the signal $V_2(t)$ minus said first substantially instantaneous difference equals zero; sensing ascending values of the signal $V_2(t)$ to a further point at which a maximum magnitude of the signal $V_2(t)$ of opposite polarity to said one polarity is reached and reversal of direction thereof occurs; then storing the value of the signal $V_2(t)$ at said further point; and sensing ascending value of the signal $V_2(t)$ to a still further point at which the substantially instantaneous value signal $V_2(t)$ exceeds the stored value of the signal $V_2(t)$ at said further point by an amount equal to the substantially instantaneous value of the time varying reference signal $V_{ref}(t)$, said pitch period being the time span between successive occurrences of said still further point.

The invention is hereinafter described with reference to the accompanying drawing in which:

FIG. 1 is a block diagram of a synthesizer system that includes a pitch and amplitude extractor of the present invention.

FIG. 2A depicts a typical electrically transduced signal from a picked guitar string;

FIG. 2B shows the peak amplitude envelope of the signal in FIG. 2A;

Figure 4:
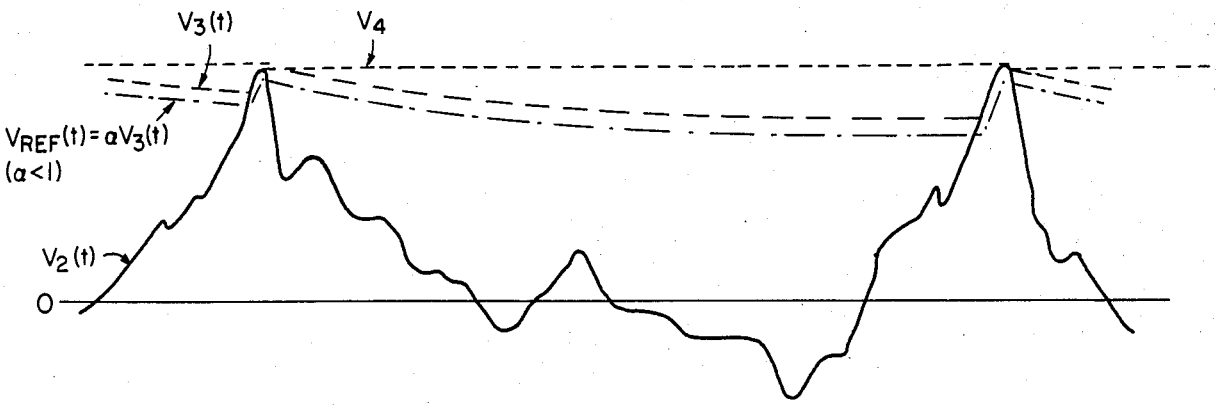
Figure 5:
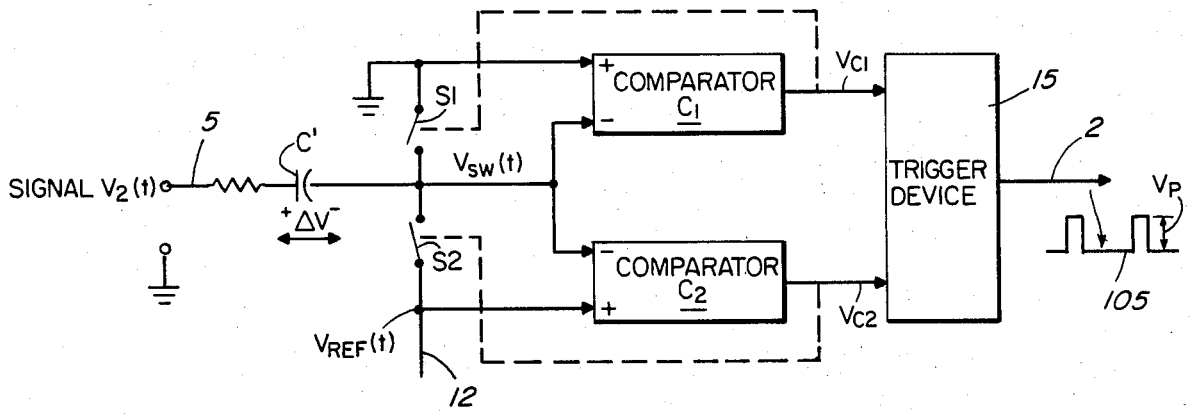
Figure 6:
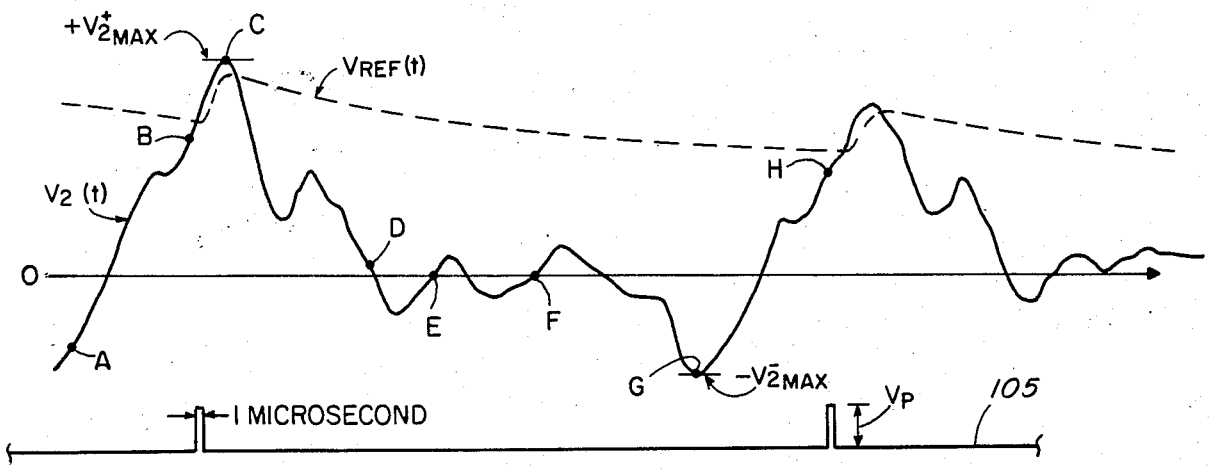

FIGS. 2C(*a*), 2C(*b*), 2C(*c*) and 2C(*d*) show detail magnified views of one period of the complex signal in FIG. 2A at the onset of string excitation at several instants thereafter during decay of the string vibration;

FIG. 3 is a diagrammatic representation of one pitch and amplitude extractor of FIG. 1 (in fact, six such extractors are used on a guitar);

FIG. 4 shows amplitude of voltage signals $V_2(t)$, $V_3(t)$, $V_4$ and $V_{ref}(t)$ in FIG. 3 as a function of time;

FIG. 5 is a schematic of the pitch extractor portion of the pitch and amplitude extractor of FIG. 1; and FIG. 6 is an amplitude vs. time voltage wave simulator of the waveform in FIG. 4 but with further legends to aid in the explanation herein.

Turning now to FIG. 1, there is shown at 101 a system embodying a guitar 102, pitch and amplitude extractor apparatus 103 and a synthesizer 104. As is shown in FIG. 1, there are six signals out from the guitar to the pitch and amplitude apparatus 103, one from each string. Each string is acoustically isolated from every other string. The output of the apparatus 103 at 2 is a digital pulse train 105 for each of the six strings, formed of pulses whose amplitude is $V_p$ and whose spacing, as later discussed, represents a measure of the fundamental pitch of the particular string (i.e., there are six pulse trains 105). There are also six outputs at 3 representing the samples peak amplitudes $V_4$ of the six strings. In what follows to simplify the explanation emphasis is placed on an explanation with respect to a single string, but it will be understood that the explanation applies to the other strings and can be applied to other string or other instruments as well. Furthermore, while the discussion covers a system with outputs at both 2 and 3 representing pitch and amplitude, respectively, yet either can be employed in the synthesizer without the other. What is done here is to provide a mechanism to permit the guitar (or other instrument) to interface with a synthesizer to produce an acoustic output from the synthesizer that is controlled by the guitar but is not guitar (or not usually guitar) sounds. In what now follows, to place the invention in context, there are some observations by the present inventor of characteristics needed to extract pitch information; this is followed by a brief discussion of proposals by others; then a detailed explanation of the present invention follows.

In FIG. 2A and more particularly in FIG. 2B, the envelope of a typical guitar output waveshape is shown rising rapidly to a maximum and decaying thereafter—at first rapidly and non-monotonically, then very gradually. The dynamic range is on the order of 50 dB. At the onset of string vibration (see FIG. 2C(*a*)), the region labeled a in FIG. 2A is greatly enlarged; there is a transient burst of both pitched and unpitched signal, a portion of which is pick noise. It is also likely that the vibration characteristics of the guitar string during and shortly following this phase are non-linear. Following the initial transient (FIGS. 2C(*a*)) the transduced wave still contains considerable harmonic content exhibited by multiple local maxima/minima (FIG. 2C(*b*), 2C(*c*), 2C(*d*)), multiple zero-crossings, and generally asymmetry with respect to its own mean value. The lower case letters a, b, c and d in FIG. 2A represent the instants of time of the representations in FIGS. 2C(*a*), 2C(*b*), 2C(*c*) and 2C(*d*), respectively. As the vibration of the string damps out (FIG. 2C(*d*)), the signal contains a diminishing harmonic content and is of considerably smaller amplitude. In the limit the signal approaches a pure fundamental wave. The exact harmonic and decay characteristics of a given note are dependent on such diverse factors as picking force, physical and mechanical characteristics of both the guitar and guitar strings, and location of the fretboard at which note is played.

Several conclusions may be drawn from FIG. 2 which have general implications for any method proposed for extracting the fundamental pitch period from such a complex electrical signal: (1) methods based solely on zero-crossing detection without drastic preconditioning of the signal are clearly inadequate and will yield erroneous measurements (likewise, acceptable methods must be immune to the occurrence of multiple adjacent local maxima/minima); (2) accurate detection of pitch period requires a method employing a form of continuous adaptation to either spectral and/or amplitude features of the complex signal (such adaptation should take place on a period-by-period basis to provide tracking of short duration spectral or amplitude changes); (3) the detection method must accommodate at least two octave ranges of fundamental pitch period (the usable range of a guitar string) and must reliably extract pitch in the presence of a 50 dB range of a signal amplitude; and (4) a suitable pitch extraction method must exhibit negligible detection delay and yield a measurement within one period of the complex signal fundamental.

With regard to conventional methods, there now follows a discussion of pitch period extraction methods which rely primarily on zero-crossing detection preceeded by a high degree of spectral lowpass filtering to suppress as much as possible all harmonics above the lowest fundamental frequency of interest. The rationale of these methods is that zero-crossing detection is a reliable pitch period measurement technique if only the fundamental component of the original signal remains after such filtering. Furthermore, a pulse train derived by such a method and having the fundamental as its repetition rate can then be converted by one of many frequency-to-voltage conversion mechanisms into a voltage proportional to pitch period. Of course, such a system requires an absolutely calibrated reference function which relates output voltage to input frequency.

If the prerequisite lowpass filtering is to be performed by a fixed filter, the typical filter for this purpose must be at least 4th order, and must be well into lowpass rolloff at the frequency to which the open guitar string is normally tuned. The ultimate attenuation rate of such a filter is 24 dB/octave of frequency. Thus, over the two octave pitch range of a guitar string, the transduced signal may undergo as much as 48 dB (256 to 1) attenuation before pitch extraction can be effected. However, the dynamic range requirement of an additionally 50 dB (300 to 1) of amplitude variation must additionally accommodated if pitch tracking is to be obtained over the entire duration of a picked note allowed to decay without muting. A dynamic range requirement of 98 dB is unacceptably stringent; thus high pre-amplification followed by compression or limiting is typically employed to reduce the dynamic range requirement of the pitch detector and to prevent overloading of the detector by input pitches near the open string fundamental. If some form of automatic gain control is attempted, the dynamic control characteristics must be carefully chosen so as not to alter the original signal waveform. Finally, it is apparent that if multiple zero-crossings in the input waveform are amplified and clipped to the same level as the maxima of the waveform, the resulting signal may exhibit a harmonic power density greater than that of the original input signal, which makes subsequent suppressions of these components even more difficult.

One method employed to circumvent some of these difficulties uses input amplitude compression followed by a filter dynamically controlled such that its cutoff frequency and attenuation characteristics are made commensurate with the harmonic suppression requirements for a specific note played on a specific guitar string. The method makes use of the observation that as notes are played successively higher on the guitar fretboard, their waveforms exhibit successively less harmonic content, presumably because the shorter string length permits few modes of vibration. The filter cutoff frequency is dynamically positioned by voltage obtained from the final pitch-to-voltage converter in the system. There are several problems with that method not the least of which is that its rationale works for the guitar but little else! In the specific case of the guitar, an absolute voltage reference corresponding to a specific pitch is necessary to estimate the fret at which the note was played (which also pre-supposes normal tuning of the instrument). Until the filter control loop has settled, the filter cutoff frequency will change during the measurement response to a transient pitch condition. To prevent this behavior, such systems are typically overdamped which introduces a slower than desirable response time to pitch fluctuations in the input signal. Finally, the filters and their responses must differ for each string, hence complicating the design and calibration of such a system.

The present invention utilizes no automatic gain control, no compression or limiting, no dynamic filtering, and requires minimal pre-conditioning to achieve accurate pitch detection. Furthermore, no absolute references are utilized, as all measurements are made on a basis relative to the signal being processed. The invention adapts continuously to both the amplitude and the waveform of the complex signal, thus accommodating both time-varying spectral content and amplitude. The method has been designed to be specifically immune to multiple zero-crossings of the signal within a pitch period. The method also exhibits excellent immunity to multiple local maxima/minima of the wave cycle.

A suitably pre-amplified complex electrical signal $V_1(t)$ in FIG. 3 (which is one signal of the six signals at 7 in FIG. 1) is provided as input to a preconditioning filter 4 the purpose of which is to suppress to a known degree the harmonic frequencies above the lowest fundamental of the guitar string and provide a complex electrical signal output $V_2(t)$. The filter 4 in practice is a simple two-pole lowpass filter with cutoff frequencies of 0.8fo and 1.25fo, where fo is the lowest open guitar string fundamental. It will be noted that over a two octave fundamental range the maximum attenuation is approximately 24 dB. The pre-conditioned output signal $V_2(t)$ is simultaneously applied to two paths 5 and 6, one being to a peak envelope detector 8 the other being to a pitch extractor 9. The peak envelope detector 8 is a peak detector exhibiting a fast attack and exponentially decaying release, the decay being controlled by a time constant T, whose magnitude is chosen to be short enough to permit the decay response to follow typically encountered downward amplitude variations of the guitar string. The output labeled 10 of the peak detector is a signal $V_3(t)$ and is reconnected as an input to an attenuator 11 having an attenuation (typically $V_{ref}(t)$ is 0.8 to 0.9 $V_3(t)$) to derive a time-varying reference signal $V_{ref}(t)$ at 12 from the complex electrical signal $V_2(t)$, which reference signal $V_{ref}(t)$ adapts continuously (i.e., from period to period of the fundamental) to peak amplitude excursions of the complex electrical signal $V_2(t)$. The output signal $V_3(t)$ of the peak detector 8 is also applied to a sample-hold device 13 whose output at 3 is a constant amplitude sample voltage $V_4$ which is updated each new extracted pitch period. (The voltage $V_4$ is a piece-wise constant representative of the signal $V_3(t)$.) FIG. 4 shows the signals $V_2(t)$, $V_3(t)$, $V_4$, and $V_{ref}(t)$. It will be noted (1) that the $V_{ref}(t)$ adapts continually to the peak magnitude variations of the signal $V_2(t)$ and (2) that zero-crossings have no effect whatever on the voltage signal $V_{ref}(t)$.

Turning to FIG. 5 a capacitor C' has a voltage drop $\Delta V$ across its terminals; the voltage drop $\Delta V$ is the stored potential difference (polarity convention as shown) at any instant as a result of prior charge transfers. One side of the capacitor C' is connected through a resistance R to the preconditioned signal $V_2(t)$. The purpose of the resistance R is (1) to isolate the driving source $V_2(t)$ from the capacitance of C' and (2) to prevent transient conditions of the signal $V_{sw}(t)$ on the other side of the capacitance C' from reaching $V_2(t)$. The other side of the capacitance C', by virtue of circuit operation, is (1) connected by a switch S1 to zero volts (ground) or (2) connected by a switch S2 to the potential $V_{ref}(t)$ or (3) left unconnected to any source potential and only to an impedance so large it is an effective open circuit.

Two voltage comparison devices or comparators C1 and C2, exhibiting very large input impedance, each sense the potential $V_{sw}(t)$, and output signals Vc1 and Vc2 as a result of comparisons of $V_{sw}(t)$ versus their reference potentials zero and $V_{ref}(t)$, respectively. The comparator C1, by its output Vc1, also controls the state of the switch S1. The comparator C2, by its output Vc2, controls the state of the switch S2. While both S1 and S2 may be simultaneously open, their closures are mutually exclusive. Outputs Vc1 and Vc2 are conveyed to a trigger device 15, the output of which is a series of short pulses, the spacing of which is the desired fundamental pitch period of $V_2(t)$. Also, it will be noted that with the polarity convention of $\Delta V$ as shown, $V_{sw}(t)=V_2(t)-\Delta V$. The comparison devices have the properties and logic now discussed.

Comparator 1: When $V_{sw}(t)$ crosses zero volts in a negative going direction, Vc1 switches to zero volts and the switch S1 is closed. When $V_{sw}(t)$ reverses direction, Vc1 switches to −VLIM, and the switch S1 opens. Comparator 2: when $V_{sw}(t)$ crosses $V_{ref}(t)$ (which is derived from $V_2(t)$, as above noted) in a positive going direction, Vc2 switches to $V_{ref}(t)$, and the switch S2 closes. When $V_{sw}(t)$ reverses direction, Vc2 switches to +VLIM, and the switch S2 opens. The potentials of +VLIM and −VLIM are the respective limiting positive and negative output excursions of the comparison device circuitry. The trigger device 15 can change its internal state only when either of the following conditions occur: (States can only occur alternately.

(*1) If Vc2 exceeds $V_{ref}(t)$ while Vc1=−VLIM, then a short duration pulse of amplitude $+V_p$ issues at the conductor 2 (i.e., one of the pulses 105A . . . ) and the output at 2 returns to 0.

(*2) If Vc1=0 while Vc2=+VLIM, then the voltage on the conductor 2 remains =0 but the trigger device 15 is enabled to produce a pulse ($+V_p$) when condition *1 above reoccurs. Each time state transition (*1) above occurs the trigger device 15 issues a short pulse $V_p$ of approximately one microsecond duration.

In the example to follow, it will be shown that the output pitch pulses of amplitude $V_p$ can occur only once per fundamental pitch period. Thus, the interpulse time interval, as encoded by any of several known digital counting techniques or devices in the synthesizer 104 in FIG. 1, is a direct measure of the fundamental pitch period of the complex electrical signal. A suitably delayed replica of these "pitch" pulses is used to operate the sampling device 13 so as to acquire a new value of peak envelope magnitude $V_4$ each new pitch period. The delay of the sampling pulse is necessary to ensure sampling $V_3(t)$ just after the new peak value has been acquired by the peak detector.

Before proceeding further it must be noted that the system is an adaptive time-varying system. Thus, to explain its operation over a single period of the input signal one must admit the initial conditions from a previous time period, specifically the stored potential $\Delta V$ on capacitor C', the value of which will generally vary with time from one period to the next.

Referring to both FIG. 6 and the arrangement of FIG. 5, the explanation begins at point A of FIG. 6; the initial condition on the capacitor C' is $\Delta V = -V^{-}_{2max}$, the potential corresponding to the maximal negative peak excursion of voltage $V_2(t)$ during the prior pitch interval. Also at point A, the switches S1 and S2 are open, Vc2=+VLIM, Vc1=−VLIM and there is a 0-volt ouptut at 2 in FIGS. 3 and 5. Use will also be made of the relation $V_{sw}(t) = V_2(t) - \Delta V$.

Beginning at point A with the voltage $V_2(t)$ increasing in a positive direction, a value of voltage $V_2(t)$ will be reached, say, at a point B, such that the voltage $V_{sw}(t)$ will exceed the voltage $V_{ref}(t)$. This occurs when $V_{sw}(t) = V_{ref}(t) = V_2(t) - \Delta V$ or when $V_2(t) = V_{ref}(t) - V^{-}_{2max}$. At point B, the output Vc2 of comparator Vc2 of comparator 2 switches to $V_{ref}(t)$ and the switch S2 closes thus holding $V_{sw}(t) = V_{ref}(t)$. The trigger device 15 makes a state transition and issues a short pulse of amplitude $V_p$ at its output 2 in FIG. 4. It will be noted that until $V_2(t)$ (also $V_{sw}(t)$) reverses direction, $V_{sw}(t)$ will increase with $V_{ref}(t)$ during the peak detector update of the voltage $V_{ref}(t)$. When the voltage $V_2(t)$ reaches its maximum and reverses direction at point C, Vc2 switches to +VLIM and S2 opens leaving on the capacitance C' a stored potential difference $\Delta V = V^{+}_{2max} - V_{ref}(t)$. At some time later, $V_2(t)$ will have decreased to a value such that $V_{sw}(t) = 0$ (point D). This occurs when $V_2(t) = \Delta V$ or when $V_2(t) = V^{+}_{2max} - V_{ref}(t)$, which indicates that $V_2(t)$ has diminished from its own maximum positive excursion by an amount equal to $V_{ref}(t)$. This occurs prior to but close to $V_2(t)$ crossing zero because $V_{ref}(t)$ is a large fraction (typically 0.9, but it can be about 0.8 to 0.9) of $V^{+}_{2max}$. This is the condition for comparator C1 to switch Vc1 to zero volts, and for the switch S1 to close thus forcing $V_{sw}(t) = 0$ while $V_2(t)$ continues in a negative direction. This is also a necessary internal condition (trigger state *2; see above) for the trigger device 15 to enable itself to issue a pulse output, but not sufficient to generate such a pulse. The multiple zero-crossings at points E and F have no effect on the trigger output. Each time $V_{sw}(t)$ crosses zero in a negative going direction, the capacitance C' charges to a potential $\Delta V = -V^{-}_{2max}$ which is held every time the voltage $V_2(t)$ reverses direction from a negative peak excursion.

A trigger pulse output at 2 can only occur if after crossing zero in a negative direction, $V_{sw}(t)$ exceeds $V_{ref}(t)$ in a positive going direction. This will occur when $V_{sw}(t) = V_2(t) - \Delta V = V_{ref}(t)$ or when $V_2(t) = -V^{-}_{2max} + V_{ref}(t)$. This states that to cause another trigger output pitch pulse at 2, the voltage $V_2(t)$ must not only cross zero once in a negative direction but must also make a positive excursion equal to $V_{ref}(t)$ above its own negative maximal excursion (point G ). It will be noted that $V_{ref}(t)$ has decayed with time to a value slightly lower than that which is acquired at point C but not substantially different from that which it has at the point B. The final transition of the pitch extractor cycle (and the start of the next period) is denoted by point H which is where the example began and where the next pitch pulse of amplitude $V_p$ is. The time span between points B and H is the pitch period of the signal $V_2(t)$.

To recapitulate briefly some of the foregoing, the time varying reference signal $V_{ref}(t)$, as shown in FIG. 3, is derived from the complex electrical signal $V_2(t)$ through the peak envelope detector 8 whose output $V_3(t)$ fed through the attenuator 11 to provide the signal $V_{ref}(t)$ at 12 as input to the pitch extractor 9; hence the signal $V_{ref}(t)$ adapts or adjusts continuously, i.e. once each period of the fundamental, to amplitude excursions of the signal $V_2(t)$. The sensing mechanism by which the signal $V_2(t)$ is sensed includes the comparators C1 and C2 which interact with the switches S1 and S2 to sense values of the signal $V_{sw}(t)$ in terms of its relationship to $V_{ref}(t)$. In the sensing cycle before discussed, a first point on the siganl waveform $V_2(t)$ in FIG. 6 is reached at which the maximum magnitude of the signal $V_2(t)$ of one polarity (i.e., the point C of + polarity) occurs; at that juncture the capacitance C' stores the substantially instantaneous difference in magnitude between the complex electrical signal $V_2(t)$ (at the point C) and the time varying reference signal $V_{ref}(t)$. The sensing mechanism thereafter senses a point (i.e., the point D) at which the magnitude of the signal $V_2(t)$ minus the before-mentioned substantially instantaneous difference equals zero (i.e., the point D in FIG. 6). The sensing mechanism then senses ascending values of the signal $V_2(t)$ to a further point G at which the maximum magnitude of the signal $V_2(t)$ of opposite polarity (i.e., —polarity in FIG. 6) to the polarity at point C is reached and reversal of direction occurs. The value of the signal $V_2(t)$ at the point G is then stored on the capacitance C. The sensing mechanism then senses ascending values of the signal $V_2(t)$ (from the point G) to a still further point H at which the substantially instantaneous value of the signal $V_2(t)$ exceeds the stored value of the signal $V_2(t)$ at the further point G by an amount equal to the substantially instantaneous value of the time-varying reference signal $V_{ref}(t)$. The pitch period of the signal $V_2(t)$ is the span between successive occurrences of the still further point, that is, the pitch period is the time span between the points B and H in FIG. 6 and is given as output by the time-spaced short pulses of the pulse train 105.

To clarify the operation of the device on a continually time varying basis, it should be realized that for a constant input signal the points B and H occur at identical points on the wave signal, that is the signal $V_2(t)$. More important is that changes in amplitude of the signal $V_2(t)$ occur slowly with respect to the cycle duration. In the case of the guitar signal, the pitch extractor is able to make adaptive changes by updating $V_{ref}(t)$ each new cycle. Although the exact points at which pulses are output on the waveform may gradually shift with harmonic content, the time interval between pitch pulses is equal to the fundamental pitch period. It should be noted also that the pitch pulses of magnitude $V_p$ are of very short duration with respect to the pitch period itself. For example, a pulse duration of one microsecond used for pitch periods of one millisecond (minimum) to tens of milliseconds (maximum) yields a very small uncertainty of period measurement due to finite pitch pulse width.

The device 103 is described above with reference to a guitar, but the concepts have use with other instruments (e.g., violin, cello, flute) as well.

Further modifications of the invention herein disclosed will occur to persons skilled in the art and all such modifications are deemed to be within the scope of the invention as defined by the appended claims.

What is claimed is:

1. A method of extracting the fundamental pitch period of a complex electrical signal $V_2(t)$, that comprises the serial steps:

deriving a time varying reference signal $V_{ref}(t)$ from the complex electrical signal $V_2(t)$, which reference signal $V_{ref}(t)$ adjusts each cycle to peak amplitude excursions of the complex electrical signal $V_2(t)$;

sensing ascending values of the signal $V_2(t)$ to a first point at which the maximum magnitude of the signal $V_2(t)$ of one polarity is reached and reversal of direction thereof occurs;

storing the first substantially instantaneous difference in magnitude between the complex electrical signal $V_2(t)$ and the time varying reference signal $V_{ref}(t)$ at said first point;

thereafter sensing a point at which the magnitude of the signal $V_2(t)$ minus said first substantially instantaneous difference equals zero;

thereafter sensing ascending values of the signal $V_2(t)$ to a further point at which a maximum magntiude of the signal $V_2(t)$ of opposite polarity to said one polarity is reached and reversal of direction thereof occurs;

then storing the value of the signal $V_2(t)$ at said further point; and sensing ascending value of the signal $V_2(t)$ to a still further point at which the substantially instantaneous value of the signal $V_2(t)$ exceeds the stored value of the signal $V_2(t)$ at said further point by an amount equal to the substantially instantaneous value of the time varying reference signal $V_{ref}(t)$, said pitch period being the time span between successive occurrences of said still further point.

2. A method according to claim 1 that further includes developing a peak amplitude signal which is derived from the complex electrical signal $V_2(t)$.

3. Apparatus for extracting the fundamental pitch period of a complex electrical signal $V_2(t)$, that comprises:

means for deriving a time varying reference signal $V_{ref}(t)$ from the complex electrical signal $V_2(t)$, which reference signal $V_{ref}(t)$ adapts each new cycle to peak amplitude excursions of the complex electrical signal $V_2(t)$;

means for sensing ascending values of the signal $V_2(t)$ to a first point at which the maximum magnitude of the signal $V_2(t)$ of one polarity is reached and reversal of direction thereof occurs; and means for storing the first substantially instantaneous difference in magnitude between the complex electrical signal $V_2(t)$ and the time varying reference signal $V_{ref}(t)$ at said first point;

said means for sensing being operable thereafter to sense a point at which the magnitude of the signal $V_2(t)$ minus said first substantially instantaneous difference equals zero;

said means for sensing being operable thereafter to sense ascending values of the signal $V_2(t)$ to a further point at which a maximum magnitude of the signal $V_2(t)$ of opposite polarity to said one polarity is reached and reversal of direction thereof occurs;

said means for storing being operable thereafter to store the value of the signal $V_2(t)$ to a still further point at which the substantially instantaneous value of the signal $V_2(t)$ exceeds the stored value of the signal $V_2(t)$ at said further point by an amount equal to the substantially instantaneous value of the time varying reference signal $V_{ref}(t)$ at said further point, said pitch period being the time span between successive occurrences of said still further point.

4. Apparatus according to claim 3 wherein said means for storing comprises an RC circuit wherein the potential difference to be stored is developed across the capacitance of the RC circuit.

5. Apparatus according to claim 4 wherein said means for sensing comprises comparator means and switch means which interact to sense the value of the signal $V_2(t)$ in terms of its relationship to $V_{ref}(t)$.

6. Apparatus according to claim 5 wherein the comparator means comprises a first comparator C1 and a second comparator C2 and said switch means comprises a first switch S1 and a second switch S2, one input, of two, to each of the first comparator C1 and the second comparator C2 being a voltage $V_{sw}(t)$ which is equal to $V_2(t)$ minus the potential difference stored in said capacitance, the second input to the comparator C1 being zero volts and the second input to the comparator C2 being the voltage $V_{ref}(t)$, the comparator outputs being voltages Vc1 and Vc2, respectively, that are connected to control the first switch S1 and the second switch S2, respectively, comparators C1 and C2 having the properties that when $V_{sw}(t)$exceeds zero volts during a negative-going excursion of $V_2(t)$ from one maximum of one polarity toward a maximum of opposite polarity Vc1 switches to zero volts and the first switch S1 is closed, when $V_2(t)$ reverses direction the voltage Vc1 switches to another voltage −VLIM which opens the first switch S1, when $V_{sw}(t)$ exceeds $V_{ref}(t)$ volts in a positive-going direction Vc2 switches to $V_{ref}(t)$ and the second switch S2 closes and when $V_{sw}$ reverses direction Vc2 switches to +VLIM and the second switch opens.

7. Apparatus according to claim 6 that includes a trigger device that receives the outputs Vc1 and Vc2 of the comparators C1 and C2, respectively, said trigger device being adapted to produce short pulses of magnitude $V_p$ whose spacing represents pitch, said trigger device being operable to change state alternately only when either of the following conditions occurs:

(*1) if Vc2 exceeds $V_{ref}(t)$ while Vc1=−VLIM, then the trigger device issues a short pulse $V_p$ at its output, or (*2) if Vc1 exceeds 0 while Vc2=+VLIM, then the output of the trigger device remains =0 but the trigger device is enabled to produce a pulse $V_p$ when condition *1 occurs.

8. Apparatus according to claim 7 wherein the pitch period is defined by the time interval between successive pulses of amplitude $V_p$ and that further includes means to provide an output signal $V_4$ representative of maximum amplitude of the signal $V_2(t)$.

9. Apparatus according to claim 8 wherein the means to provide an output signal representative of the maximum amplitude of the signal $V_2(t)$ comprises a peak envelope detector connected to receive the signal $V_2(t)$ and a sample and hold circuit connected to receive as input thereto the output of the peak envelope detector and operable to provide the amplitude signal $V_4$ as output.

10. Apparatus according to claim 9 wherein the pulses of amplitude $V_p$ are connected through delay logic to the sample and hold circuit to serve as a clocking pulse on the sample and hold circuit.

11. A system that includes a pitch extractor and amplitude extractor according to claim 10 that further includes an instrument to provide an electrical signal $V_1(t)$, means to precondition the electrical signal $V_1(t)$ to provide said signal $V_2(t)$ and a synthesizer connected to receive the pulses of amplitude $V_p$ and the amplitude signal $V_4$ as two inputs thereto and operable to provide a musical output on the basis of the two inputs.

12. A system that includes a pitch extractor and amplitude extractor according to claim 11 wherein said instrument is a string instrument.

13. A system that includes a pitch extractor and amplitude extractor according to claim 12 wherein the string instrument is a guitar.

14. A system that includes a pitch extractor and amplitude extractor according to claim 11 that further includes transducing means operable to convert natural vibrational energy emanating from the instrument to form the electrical signal $V_1(t)$.

15. A system that includes a pitch extractor and amplitude extractor according to claim 11 wherein said instrument is a source of acoustic-energy and which includes transducing means operable to convert the acoustic energy to said electrical signal $V_1(t)$.

16. Apparatus for extracting the fundamental pitch period of a complex electrical signal that comprises;

means for deriving a time varying reference signal from the complex electrical signal, which reference signal adapts each new cycle to peak amplitude excursions of the complex electrical signal;

means for sensing ascending values of the complex electrical signal to a first point at which the maximum magnitude of the complex electrical signal of one polarity is reached and reversal of direction thereof occurs; and means for storing the first substantially instantaneous difference in magnitude between the complex electrical signal and the time varying reference signal at said first point;

said means for sensing being operable therafter to sense ascending values of the complex electrical signal to a further point at which a maximum magnitude of the complex electrical signal of opposite polarity to said one polarity is reached and reversal of direction thereof occurs;

said means for storing being operable thereafter to store the value of the complex electrical signal at said further point;

said means for sensing being operable to sense therafter ascending values of the complex electrical signal to a still further point at which the substantially instantaneous value of the complex electrical signal exceeds the stored value of the complex electrical signal by an amount equal to the substantially instantaneous value of the time varying reference signal, said pitch period being the time span between successive occurrences of said still further point.

17. A method of extracting the fundamental pitch period of a complex electrical signal, that comprises the serial steps;

deriving a time varying reference signal from the complex electrical signal, which time varying reference signal adapts each new cylce to excursions of the complex electrical signal from one peak amplitude to another peak amplitude;

sensing ascending values of the complex electrical signal to a first point at which one peak amplitude of the complex electrical signal of one polarity is reached and reversal of direction thereof occurs;

storing the first substantially instantaneous difference in amplitude between the complex electrical signal and the time varying reference signal at said first point;

thereafter sensing a point at which amplitude of the complex electrical signal minus said first substantially instantaneous difference signal equals zero;

thereafter sensing ascending values of the complex electrical signal to a further point at which a maximum amplitude of the complex electrical signal of opposite polarity to said one polarity is reached and reversal of direction thereof occurs;

then storing the value of the complex electrical signal at said further point; and sensing ascending values of the complex electrical signal to a still further point at which the substantially instantaneous value of the complex electrical signal exceeds the stored value of the signal at said further point by an amount equal to the substantially instantaneous value of the time varying reference signal, said pitch period being the time span between successive occurrences of said still further point.

18. A method according to claim 17 that further includes developing a peak amplitude signal which is dervied from the complex electrical signal.

19. A method according to claim 17 that further includes generating a train of pitch pulses, each of whose duration is very short compared to said pitch period.

20. A method according to claim 19 wherein the duration of the pitch pulse is about a microsecond and the pitch period is no less than about a millisecond.

21. A method according to claim 19 wherein the complex electrical signal is periodic, wherein changes in amplitude of complex electrical signal from cycle to cycle are small, and wherein said still further point occurs at the identical point on successive cycles of said complex electrical signal.

22. A method according to claim 17 wherein the time varying reference signal is only slightly smaller than the peak amplitude of the complex electrical signal.

23. A method according to claim 22 wherein the time varying reference signal is about 0.8 to 0.9 times the peak amplitude of the complex electrical signal.

* * * * *